US005855283A

United States Patent [19]

Johnson

[11] Patent Number: 5,855,283

[45] Date of Patent: Jan. 5, 1999

[54] PRODUCT DISPLAY

[75] Inventor: Allen E. Johnson, Hartford, Wis.

[73] Assignee: DCI Marketing, Inc., Milwaukee, Wis.

[21] Appl. No.: 903,903

[22] Filed: Jul. 31, 1997

[51] Int. Cl.[6] ..... A47F 5/00

[52] U.S. Cl. ..... 211/59.3; 211/103; 211/106; 211/85.17; 211/175

[58] Field of Search ..... 211/59.2, 59.3, 211/103, 106, 51, 85.17; 312/71

[56] References Cited

U.S. PATENT DOCUMENTS

| | | | |
|---|---|---|---|
| 4,130,203 | 12/1978 | Russell | 211/51 |
| 5,012,936 | 5/1991 | Crum | 211/59.3 |
| 5,366,099 | 11/1994 | Schmid | 211/59.3 |
| 5,542,552 | 8/1996 | Yablans et al. | 211/59.3 |
| 5,605,237 | 2/1997 | Richardson et al. | 211/59.3 |
| 5,665,304 | 9/1997 | Heinen et al. | 211/59.3 X |
| 5,673,801 | 10/1997 | Markson | 312/71 X |
| 5,746,328 | 5/1998 | Beeler et al. | 211/59.3 |
| 5,769,248 | 6/1998 | Johnson | 211/106 |

*Primary Examiner*—Robert W. Gibson, Jr.
*Attorney, Agent, or Firm*—Michael Best & Friedrich LLP

[57] ABSTRACT

A product display including a track, a tray having a top surface upon which products are displayed, and interengagable members on the track and tray for enabling the tray to have a first mode of operation wherein the interengagable members are disengaged allowing the tray to move relative to the track and a second mode of operation wherein the interengagable members are interengaged prohibiting movement of the tray relative to the track. A biasing member urges products on the displayed toward the front of the display. Adjustable guide members are positioned adjacent the display surface for containing products on the display surface. The guide members are adjustable to accommodate various sizes of products.

37 Claims, 7 Drawing Sheets

14
12
198
116
110
240
30
270
324
328
118
188
32
104
102
92
34
54
330
280
326
322
280a

PRODUCT DISPLAY

FIELD OF THE INVENTION

The invention relates to a product display, and more particularly, to an automatic feed product display that is adjustable to enable the display of various sized products.

BACKGROUND OF THE INVENTION

Product displays are important to retailers for displaying products. Product displays should be aesthetically pleasing to attract consumers to the products that are displayed. Typically, product displays are configured so as to display one size of product requiring the retailer to purchase many different sizes of displays to display the retailer's products.

One type of product display, the automatic feed product display, has become increasingly popular for displaying products. This type of display is configured so as to maintain products to be displayed at the front of the display to enhance access to and visibility of products to the consumer. The automatic feed displays eliminate a customer having to reach into the display to access a product. Conventional automatic feed displays typically are awkward or difficult to load due to the configuration of the bias that is maintained on the products to keep them at the front of the display.

SUMMARY OF THE INVENTION

The invention provides an improved product display that addresses the above problems. The product display of the present invention includes a track having an elongate channel and a tray having a top surface upon which products are displayed. The top surface of the tray has an elongate aperture that communicates with the channel in the track. Interengagable members are positioned on the track and on the tray. A biasing member is positioned in the channel which urges displayed products toward the front of the product display. A guide member is positioned adjacent the display surface of the tray for containing the products on the display surface. The guide member is adjustable to accommodate varying widths of products.

The product display normally operates in a first mode wherein the interengagable members are interengaged thus prohibiting movement of the tray relative to the track. Products can then be removed from the product display by a consumer and the remainder of the products will be urged forward. The second mode of operation occurs when the product display is to be stocked/restocked with products. In the second mode, the interengagable members are disengaged allowing the tray to move relative to the track making loading of products on the product display easier because the products to not have to be loaded against the bias of the biasing member.

It is an object of the present invention to provide an improved product display.

It is another object of the present invention to provide a product display that overcomes the problems of conventional displays.

It is another object of the present invention to provide a product display that is able to accommodate various sizes of products.

It is another object of the present invention to provide an automatic feed product display onto which it is easier to load products.

It is another object of the present invention to provide a product display that is mountable onto a grid of horizontal rods.

Other features and advantages of the invention will become apparent to those of ordinary skill in the art upon review of the following detailed description, claims, and drawings.

Figure 1:
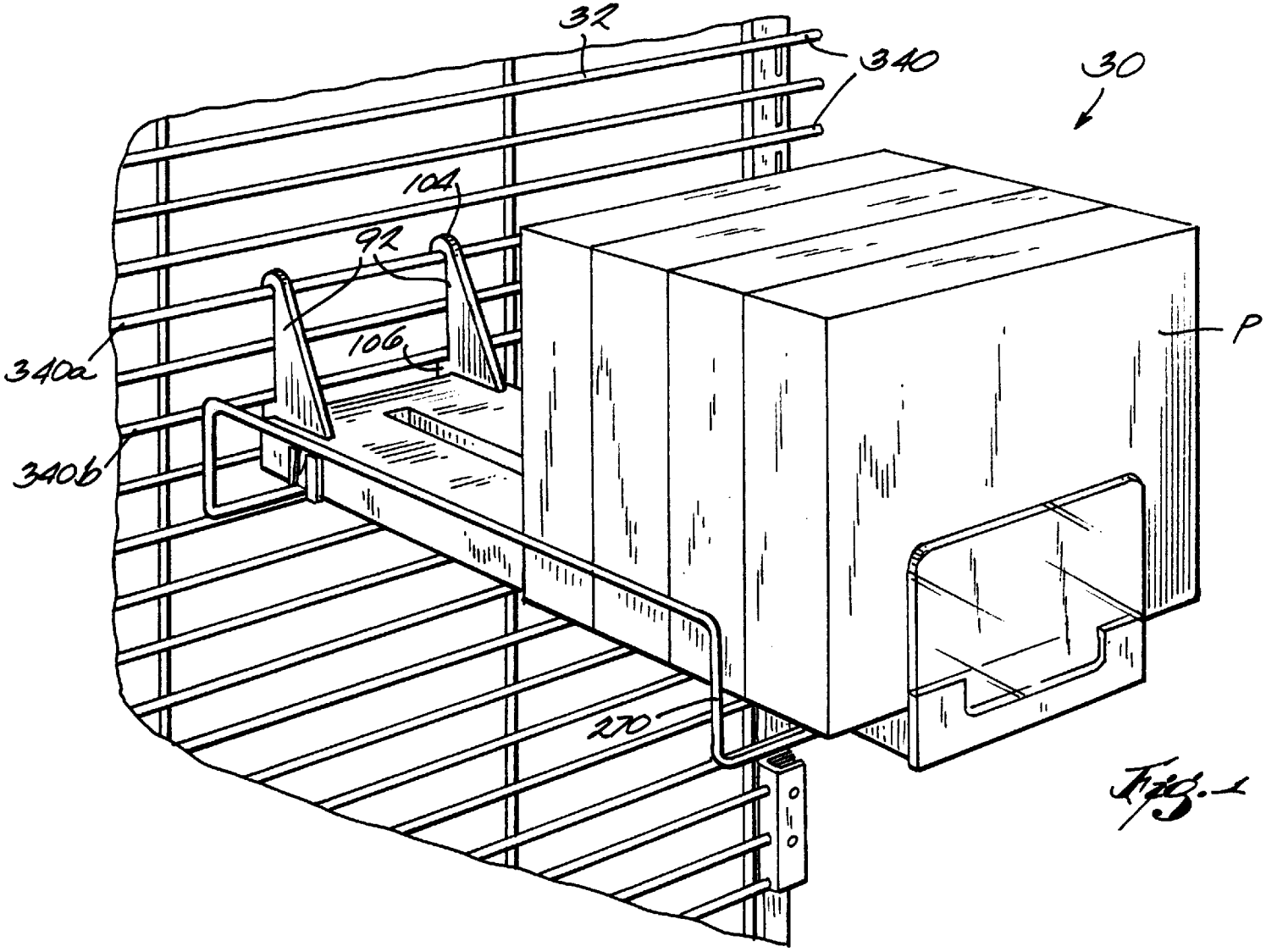
FIG. 1 is a perspective view of a product display embodying the invention in a first mode of operation.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Referring now to the drawings, there is shown in FIG. 1 the product display 30 embodying the invention. The product display 30 is shown displaying products P. The product display 30 is supported by a support structure such as the grid system 32.

Figure 2:
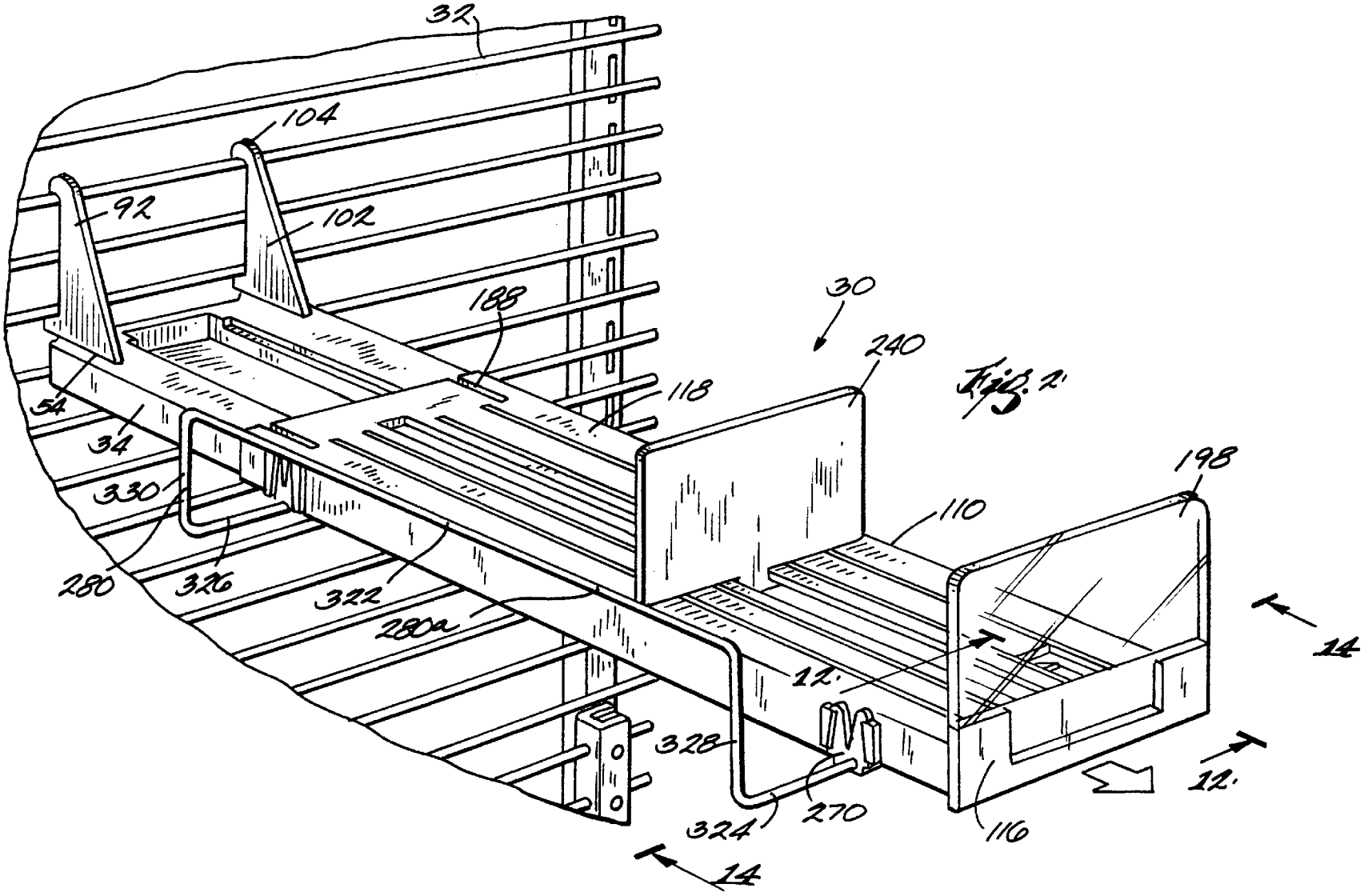
FIG. 2 is a perspective view of the product display in a second mode of operation.
Figure 3:
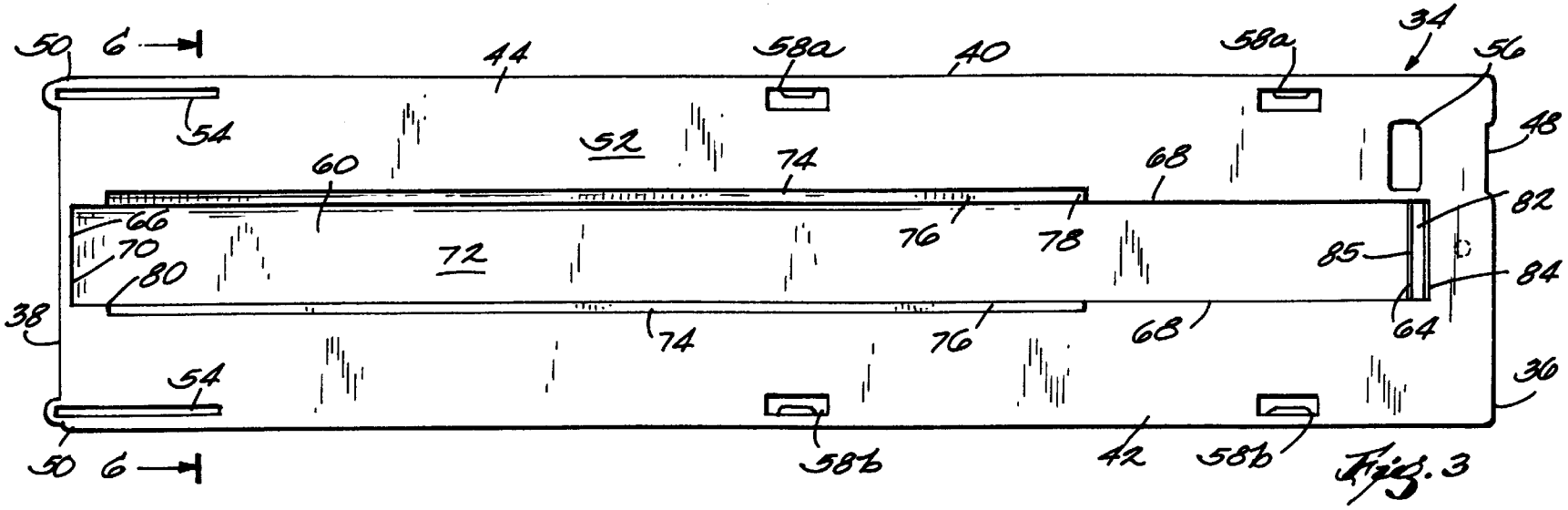
FIG. 3 is a plan view of a track.
Figure 4:
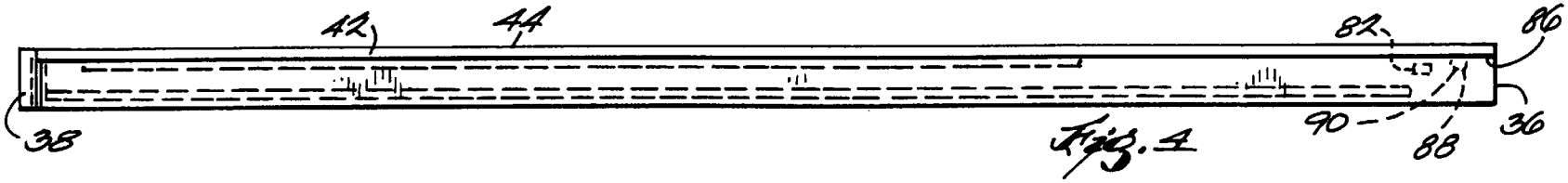
FIG. 4 is a side view of the track.
Figure 5:
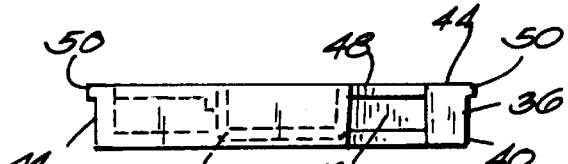
FIG. 5 is an end view of the track.

As shown in FIG. 2 and particularly in FIGS. 3 through 6, the product display 30 includes a first member or track 34 that is generally rectangular. However, the track 34 can have alternate configurations. The track 34 includes a front wall 36, a rear wall 38, a side wall 40, a side wall 42 and a top wall 44. The front wall 36 has therein a rectangular aperture 46 adjacent the side wall 40 (FIG. 5). The front wall 36 includes a notched area 48 above the aperture 46 and adjacent the top wall 44 (FIGS. 3 and 5). Each side wall 40 and 42 includes a flange 50 extending outwardly from the respective side wall 40 or 42. The flange 50 is co-planar with the top wall 44 (FIG. 5).

Figure 6:
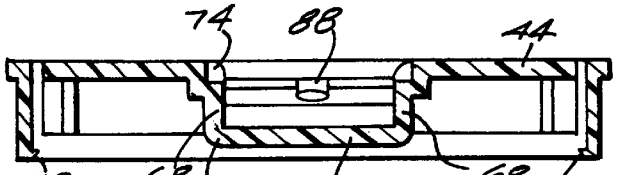
FIG. 6 is a sectional view taken along line 6—6 of FIG. 3.

As best shown in FIG. 3, the top wall 44 extends between the side walls 40 and 42 and between the front wall 36 and the rear wall 38. The top wall 44 has a top surface 52. The top wall 44 has therein a pair of narrow rectangular slots 54 with one slot positioned adjacent each side wall 40 and 42. Each slot 54 is generally parallel to its respective adjacent side wall 40 or 42. The top wall 44 has therein a rectangular aperture 56 adjacent the front wall 36 and generally aligned with the notched area 48. The top wall 44 has therein four apertures 58 with two apertures 58*a* adjacent the side wall 40 and two apertures 58*b* adjacent the side wall 42. As best shown in FIGS. 3 and 6, each side walls 40 and 42 has thereon an inwardly directed projection 59 that is aligned with and below each aperture 58.

As shown in FIG. 2 through 6, the top wall 44 includes a central opening 60 that is generally rectangular. A trough 62 depends from the periphery of the opening 60. The trough 62 has a front end 64 and a back end 66 and a length extending from approximately the rear wall 38 to a distance inward of the front wall 36. The trough 62 is defined by a pair of side walls 68, an end wall 70 and a web 72 defining the bottom of the trough 62. For a portion of the length of the trough 62, there is a relieved area 74 that defines a step 76 having a front end 78 and a back end 80.

With reference to FIGS. 3 and 4, the front end 64 of the trough 62 includes a wall 82 that extends between the side walls 68 of the trough 62. A slot 84 is defined by the top wall 44 and the wall 82 and a slot 85 is defined by the wall 82 and the web 72 of the trough 62. In a direction toward the front wall 36 from the wall 82 and depending from a bottom surface 86 of the top wall 44 is a projection 88. The projection 88 is generally cylindrical having a chamfered lower end 90.

Figure 22:
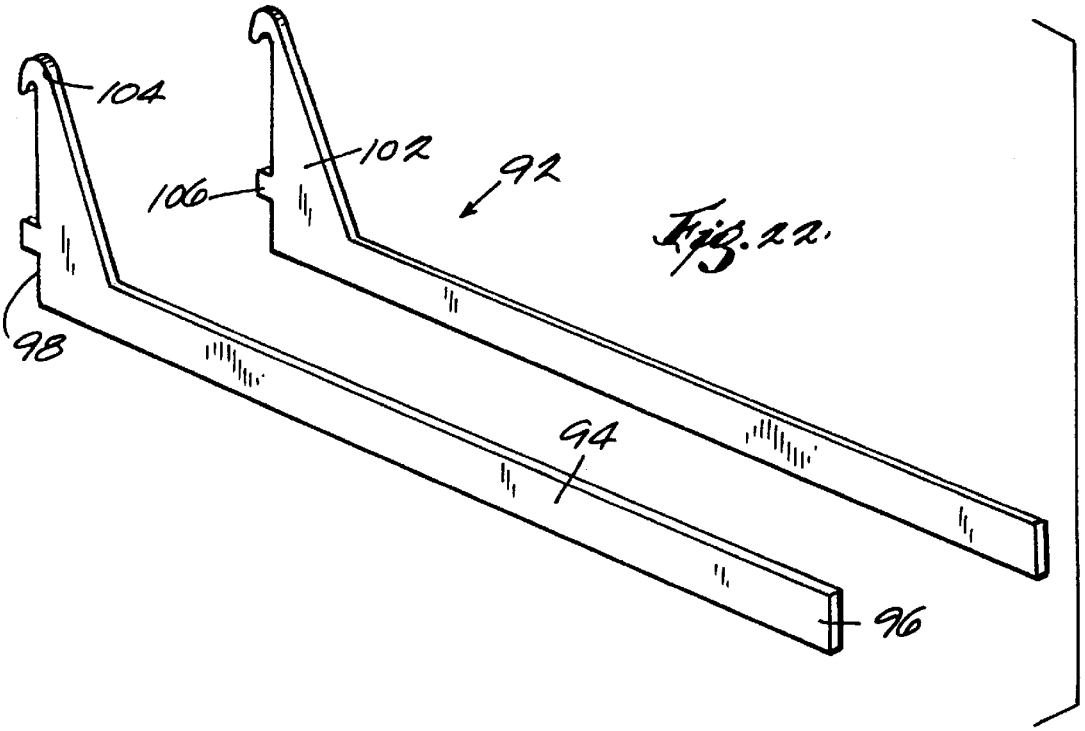
FIG. 22 is a perspective view of a pair of side supports.

Turning now to FIGS. 1 and 22, the product display 30 further includes a pair of side supports 92. Each side support 92 includes an elongate portion 94 having a first end 96 and a second end 98. A triangular portion 102 extends upwardly from the second end 98. The triangular portion 102 terminates upwardly in a hook portion 104. A projection 106 extends outwardly from a side 106 of the triangular portion 102.

With reference to FIGS. 2, 3 and 6, the side supports 92 are secured to the track 34 as follows. The triangular portion 102 of one of the side supports 92 is aligned from below with one of the slots 54 in the top wall 44 of the track 34. The side supports 92 are raised upwardly such that the triangular portion 102 pass through the slot 54 and thereafter extends upwardly from the top wall 44 of the track 34. The elongate portion 94 of each side support 92 is raised so as to snap into position abutting the respective side wall 40 or 42 and be supported by the projections 59 on the side walls 40 and 42.

As shown in FIGS. 2 and 7 through 10, the product display 30 further includes a second member or slidable tray 110 positionable on and slidable along the track 34. Specifically, the tray 110 includes a side wall 112, a side wall 114, a front wall 116 and a top wall 118. The top wall 118 has a front edge 120 and a back edge 122.

Figure 8:
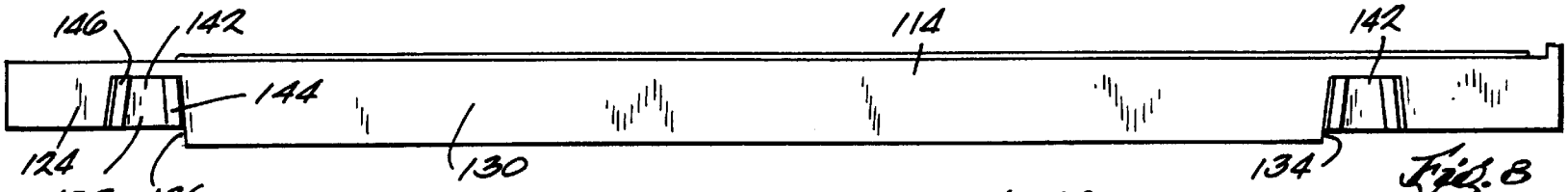
FIG. 8 is a side view of the tray.
Figure 10:
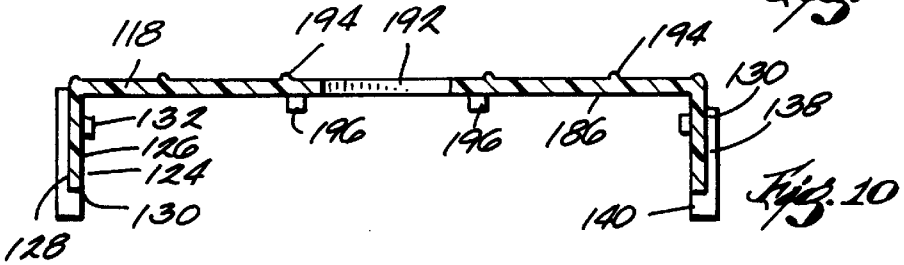
FIG. 10 is a sectional view taken along line 10—10 of FIG. 7.

With specific reference to FIG. 8 and 10, each of the side walls 112 and 114 includes an elongate wall 124 extending between the front wall 116 and the back edge 122 of the top wall 118. Each wall 124 includes an inner surface 126, an outer surface 128 and a bottom edge 130. An elongate projection 132 extends inwardly from the inner surface 126 of each wall 124 in a direction toward the center of the tray 110. The projections 132 extend along the wall 124 from approximately the back edge 122 of the top wall 118 and about a third of the length of the wall 124. Each side wall 112 and 114 further includes a wall 130 that does not extend the full length of the wall 124. The wall 130 has a first end edge 134 and a second end edge 136. The wall 130 is generally L-shaped in cross-section (FIG. 10) and includes a first leg 138 and a second leg 140. The first leg 138 abuts the outer surface 128 of the wall 124. The second leg 140 abuts the bottom edge 130 of the wall 124. A generally V-shaped guide member 142 is adjacent both end edges 134 and 136 of walls 130. Each guide member 142 includes two projections 144 and 146 that angle toward each other preferably five degrees from a vertical axis. The two projections 144 and 146 of each guide member 142 define therebetween a channel 152.

Figure 7:
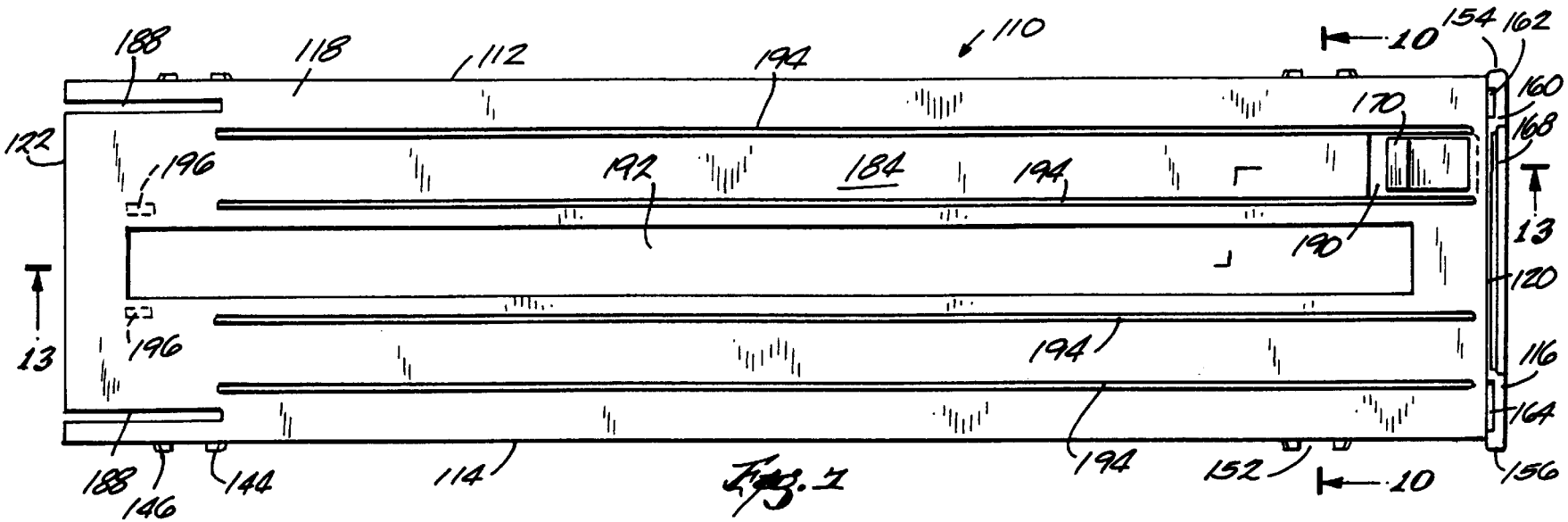
FIG. 7 plan view of the tray.
Figure 9:
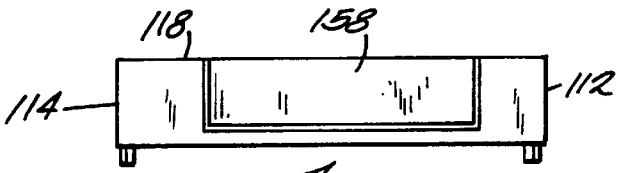
FIG. 9 is an end view of the tray.

As shown particularly in FIGS. 7 and 9, the front wall 116 of the tray 110 extends past each of the side walls 112 and 114 to define side edges 154 and 156 of the front wall 116. The front wall 116 has therein a generally rectangular relieved area 158 (FIG. 9). The front wall 116 has a top surface 160 having therein a slot 162 near the side edge 154, a slot 164 near the side edge 156, and a center slot 168 therebetween.

Figure 13:
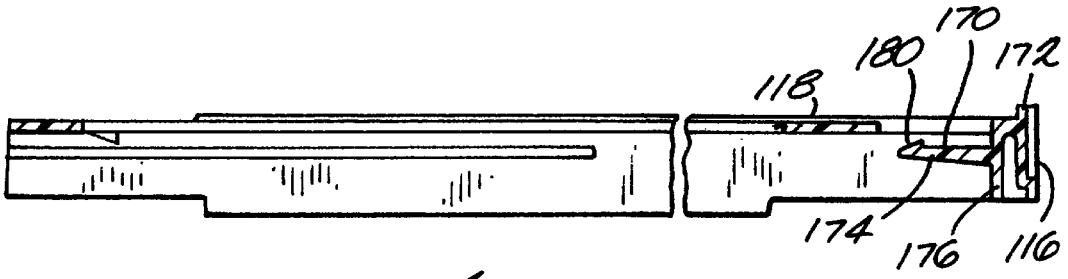
FIG. 13 is a sectional view taken along line 13—13 of FIG. 7.

Referring now to FIGS. 7 and 13, a resilient leg 170 extends from the front wall 116 in the direction toward the guide members 142. The resilient leg 170 is positioned below the top wall 118. The resilient leg 170 includes a support wall 172, an arm 174 and a member 176 therebetween that acts as a hinge. The arm 174 is positioned so as to extend upwardly from the horizontal and preferably, extends upwardly on the order of three degrees. A triangular hook 180 portion extends upwardly from the end of the arm 176 opposite the member 174.

Figure 11:
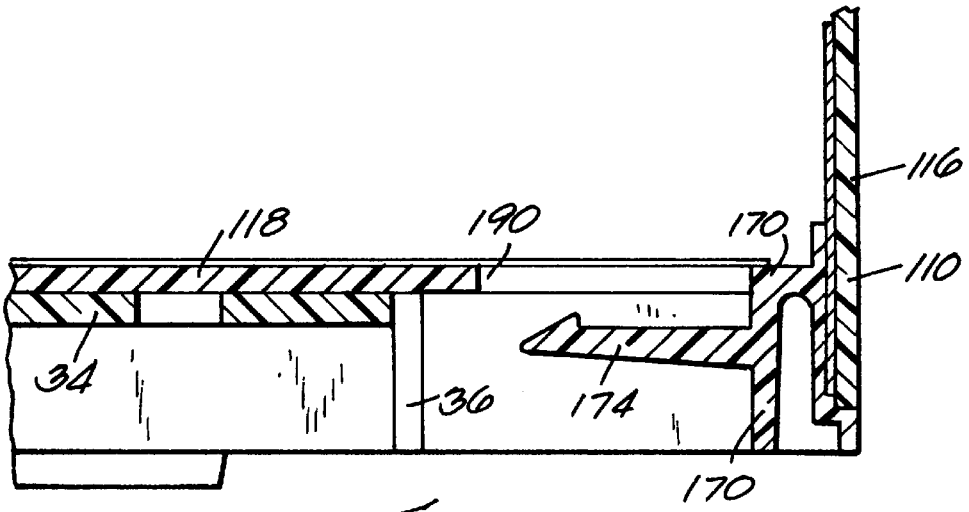
FIG. 11 is a partial sectional view of the tray.

As best shown in FIGS. 7 and 10, the top wall 118 has a top surface 184 and a bottom surface 186. The top surface 184 has therein a pair of rectangular slots 188 that extend inwardly from the back edge 122 toward the front wall 116 and the top surface 184 has therein a rectangular aperture 190 immediately above and aligned with the resilient leg 170 (FIG. 11). The top surface 184 has therein a central generally rectangular opening 192 that extends from a distance adjacent the back edge 122 to a distance adjacent the front wall 116. Elongate ribs 194 extend along the top surface 184. Each rib 194 is preferably semicircular in cross-section (FIG. 10) and each rib 194 is elongate in the direction of the central opening 192.

A pair of stops 196 depend from the bottom surface 186 of the top wall 118. As shown in phantom in FIG. 7, the stops 196 are positioned one on each side of the central opening 192 near the back edge 122 of the top wall 118. Preferably, each of the stops 196 is generally trapezoidal in cross-section.

Figure 14:
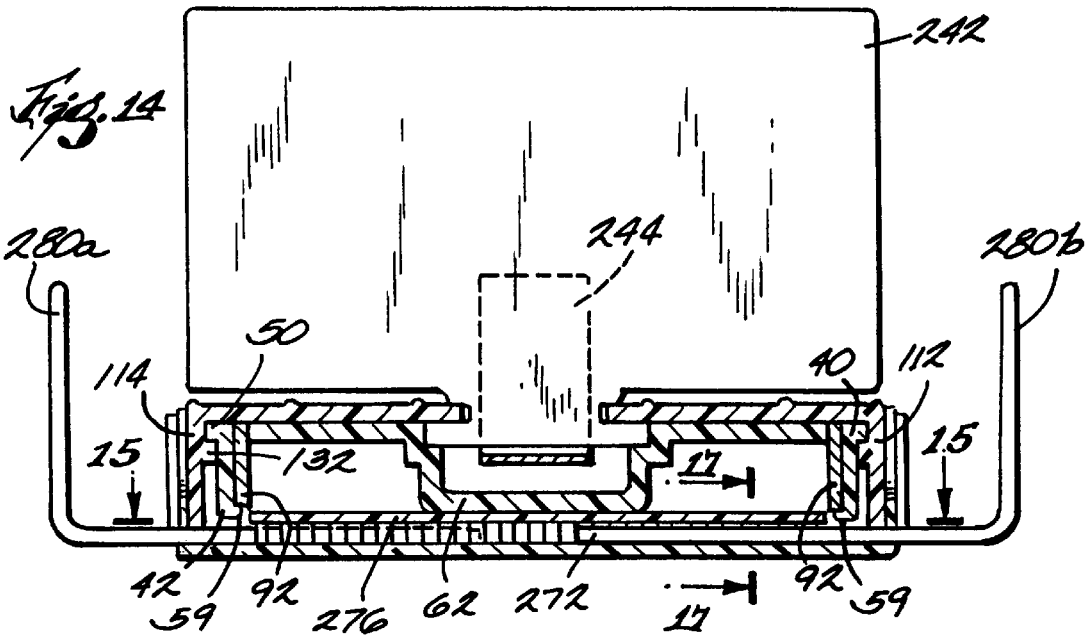
FIG. 14 is a sectional view taken along line 14—14 of FIG. 2.
Figure 15:
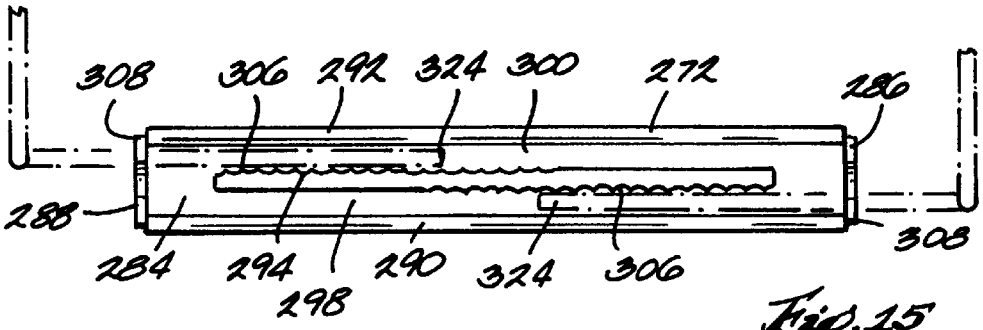
FIG. 15 is a plan view of a railing retainer.

The track 34 with secured side supports 92 and the tray 110 are assembled as follows with reference to FIGS. 1, 2, 11, 12 and 14. The tray 110 is threaded onto the track 34 by first aligning the back edge 122 of the top wall 118 of the tray 110 with the top surface 52 of the top wall 44 of the track 34. The tray 110 is then moved toward the rear wall 38 of the track 34 so that each flange 50 of the side walls 40 and 42 of the track 34 is positioned between the bottom surface 186 of the top wall 118 and the projection 132 on the side walls 112 and 114 of the tray 110 (FIG. 14). In this orientation, the side walls 112 and 114 of the tray 110 surround the side walls 40 and 42 of the track 34 and the front wall 116 of the tray 110 is adjacent and in front of the front wall 36 of the track 34. Some resistance to the rearward motion will be detected until the stops 196 travel rearwardly enough to be positioned in the relieved areas 74 of the trough 62 which will be their normal position.

Figure 12:
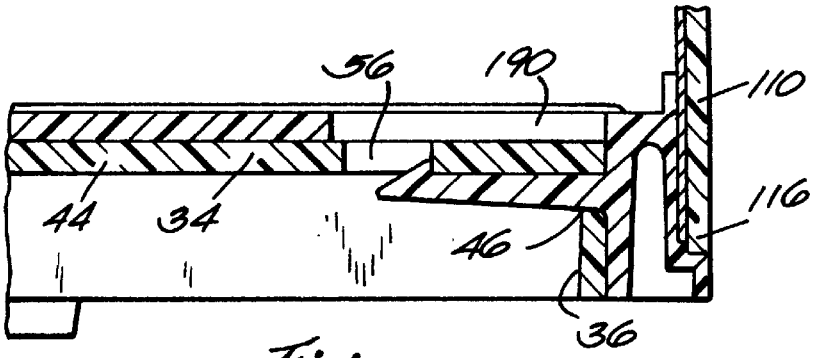
FIG. 12 is a sectional view taken along line 12—12 of FIG. 2.

When in the regular use mode or first mode of operation, the tray 110 and the track 34 are interengaged such that the tray 110 is not slidable along and relative to the track 34. To interengage the tray 110 and the track 34 and with reference to FIGS. 2, 11 and 12, the tray 110 is slid rearwardly toward the rear wall 38 of the track 34. Such rearward motion causes the slots 188 to surround the triangular portions 102 of the side supports 92 that extend upwardly from the track 34. Upon further rearward motion, the arm 174 of the resilient leg 170 of the tray 110 enters the aperture 56 in the front wall 36 of the track 34 and interengages with the aperture 56 in the top wall 44 of the track 34 thus securing the tray 116 to the track 34 (FIG. 12).

The resilient leg 170 and the aperture 56 define means on the track 34 and the tray 110 for interengaging the track 34 and the tray 110 to selectively prohibit the tray 110 from sliding on the track 34 and to alternately allow the tray 110 to slide along the track 34. The resilient leg 170 and the aperture 56 further define interengagable members on the track 34 and the tray 110 for enabling the tray 110 to have a first mode of operation wherein the interengagable members are disengaged allowing the tray 110 to move relative to the track 34 and a second mode of operation wherein the interengagable members are interengaged prohibiting movement of the tray 110 relative to the track 34.

Figure 19:
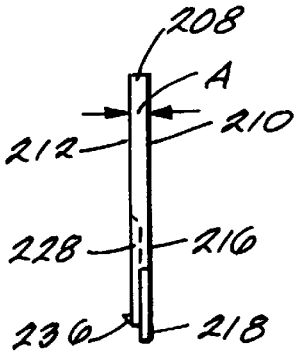
FIG. 19 is a side view of the front plate.
Figure 18:
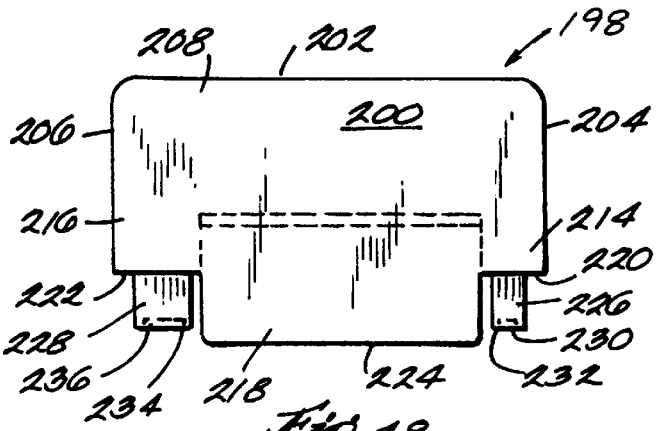
FIG. 18 is a plan view of a front plate.

Turning now to FIG. 2 and particularly FIGS. 18 and 19, the product display 30 further includes a front plate 198 that is aligned with the front wall 116 of the tray 110. The front plate 198 acts as a product stop so that products P do not inadvertently fall from the product display 30 over the front wall 116 of the tray 34. The front plate 198 includes a display surface 200 on which indicia such as graphics, information, advertising or the like can be placed. The front plate 198 includes a top edge 202 and a pair of side edges 204 and 206. The front plate 198 includes an upper generally rectangular portion 208 having a uniform width A and a front face 210 and a rear face 212. Depending from and integral with the front face 210 of the upper portion 208 are three wall portions, a first wall portion 214 adjacent the side edge 204, a second wall portion 216 adjacent the side edge 206 and a central wall portion 218 between the first and second wall portions 214 and 216. The first, second and central wall portions 214, 216 and 218 respectively have a reduced width that is less than width A of the upper portion 208. The first and second wall portions 214 and 216 each have a lower end 220 and 222 respectively. The central wall portion 218 terminates in a lower end 224. The lower end 224 terminates further from the top edge 202 than do lower edges 220 and 222.

Depending from the rear face 212 of the upper portion 208 are two downwardly extending projections 226 and 228. A first projection 226 is adjacent to and spaced from the side edge 204 and is also spaced from the central wall portion 218. The first projection 226 is adjacent and abuts a part of the first wall portion 214. The first projection 226 terminates in a lower end 230 having thereon an upwardly extending hook 232. The second projection 228 is adjacent to and spaced from the side edge 206 and is also spaced from the central wall portion 218. The second projection 228 is adjacent and abuts a part of the second wall portion 216. The second projection 228 terminates in a lower end 234 having thereon an upwardly extending hook 236.

The widths of the first wall portion 214 and the first projection 226, where they abut, equal the width A of the upper portion 208. Similarly, the widths of the second wall portion 216 and the second projection 228, where they abut, equal the width A of the upper portion 208 (FIG. 19).

To position the front plate 198 on the product display 30, the front plate 198 is positioned above the front wall 116 and the center wall portion 218 is aligned with the slot 168, the first projection 226 is aligned with the slot 162 and the second projection 228 is aligned with the slot 164. Downward movement of the front plate 198 inserts the first projection 226 into the slot 162, the second projection 228 into the slot 164 and the central wall portion 218 into the slot 168. The hooks 232 and 236 of the projections 226 and 228 interengage with the lower ends of the slots 162 and 164 to secure the front plate 198 in position.

Figure 21:
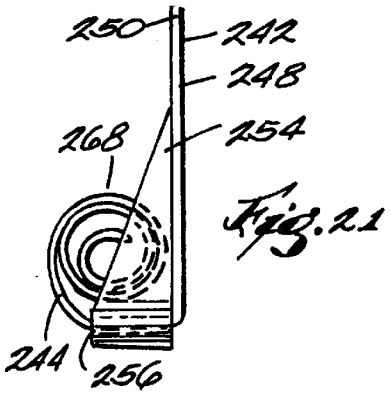
FIG. 21 is a side view of the pusher plate.
Figure 20:
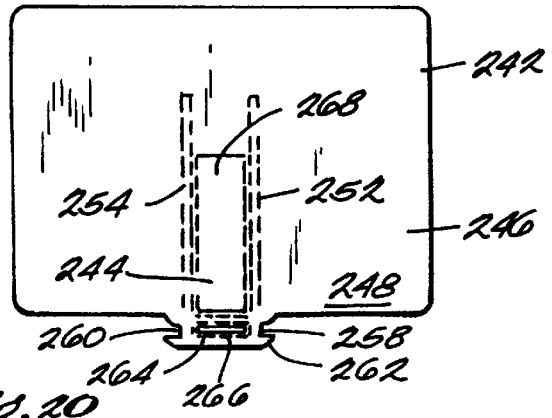
FIG. 20 is a plan view of a pusher plate.

To ensure that products are always at the front of the product display 30, a biasing mechanism 240 is employed to bias the products P toward the front wall 116 for easier consumer access. As shown in FIGS. 20 and 21, the biasing mechanism 240 includes a pusher plate 242 and a coil spring 244. The pusher plate 242 includes a generally rectangular front wall 246 having a front face 248 and a rear face 250. Products P are positionable against and in front of the front face 248. A pair of spaced triangular side walls 252 and 254 extend outwardly from the rear face 250 of the front wall 246. A guide member 256 extends downwardly from the side walls 252 and 254. The guide member 256 includes a pair of legs 258 and 260 with the leg 258 depending from the side walls 252 and the legs 260 depending from the side wall 254. A skid 262 depends from the legs 258 and 260. The skid includes slot 264. The coil spring 244 of the biasing mechanism 240 includes an end 266 and the remainder of the coil spring 244 wrapped into a coil portion 268. The end 266 has therein an aperture.

The biasing mechanism 240 is assembled into the product display 30 as follows. The pusher plate 242 is inserted into the trough 62 by aligning the pusher plate 242 with the trough 62 such that the ends 264 of the skid 262 extend in the trough 62 in the same elongate direction as the trough 62. The pusher plate 242 is then lowered into the trough 62 and rotated 90 degrees. In this rotated orientation, the skid 262 abuts the top wall 44 of the track 34. The end 266 of the coil spring 244 is fed through the slot 264 of the skid 262 then through either the slot 84 or the slot 85 at the front end 64 of the trough 62. The aperture of the end 266 of the coil spring 244 is then interengaged with the projection 88 on the track 34 to secure the end 266 of the coil spring 244 to the track 34. The coil portion 268 abuts the rear face 250 of the front wall 246 of the pusher plate 242. The coil spring 244 biases the pusher plate 242 forwardly toward the front wall 116 of the tray 110. The front end 64 of the trough 62 having the step 84 acts as a stop for the biasing mechanism 240 in that the pusher plate 242 cannot more forwardly of the front end 64 of the trough 62.

Turning now to FIGS. 2, 14–15 and 17–18, the product display 30 further includes a retaining system 270 for adjustably retaining different sized products on the product display 30. The retaining system 270 includes a pair of railing retainers 272, a pair of retainer covers 276, and a pair of guides or rails 280.

As best shown in FIGS. 14 through 17, each railing retainer 272 include an elongate body portion 284 that is generally C-shaped. Specifically, the body portion 284 includes a first end 286 and second end 288, a pair of spaced elongate side walls 290 and 292 and an elongate center wall 294 between the side walls 290 and 292. The side walls 290 and 292 and the center wall 294 extend between the first end 286 and the second end 288 of the body portion 284. Each of the side walls 290 and 292 terminates in an upper rounded surface 296. The side wall 290 and the center wall 294 define a first channel 298 and the side wall 292 and the central wall 294 define a second channel 300. The center wall 294 includes a first surface 302 that faces the side wall 290 and a second surface 304 that faces the side wall 292. A portion of the first surface 302 near the first end 286 of the body portion 284 is non-planar and has therein scalloped relieved areas 306. A portion of the second surface 304 near the second end 288 of the body portion 284 is non-planar and has therein scalloped relieved areas 306.

A retaining clip 308 extends upwardly from the first end 286 and from the second end 288 of the body portion 284. Each retaining clip 308 includes a pair of upwardly extending resilient legs 310 each having thereon an outwardly extending hook portion 312.

Figure 17:
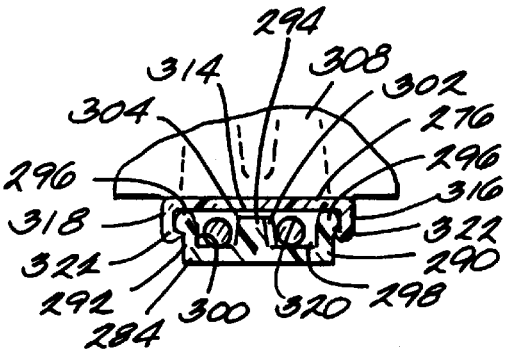
FIG. 17 is a sectional view taken along line 17—17 of FIG. 14.

As shown in FIGS. 14 and 17, each of the retainer covers 276 are generally elongate and include a body portion 314 and a pair of side walls 316 and 318 the define its generally C-shape. The body portion 314 includes an inner surface 320. The side walls 316 and 318 each terminate in an inwardly facing projection 322.

Referring to FIG. 2, preferably the product display 30 includes two rails 280*a* and 280*b*. Only one rail 280*a* is shown in FIGS. 1 and 2. Each of the pair of rails 280 is preferably a metal rod having a diameter sufficient to afford some rigidity to the rails. Each rail 280 has a first end 324 and a second end 326 and is preferably shaped as follows. The first end 324 and the second end 326 are bent as to be parallel. The portions of the rail 280 adjacent the ends 324 and 326 are bent 90 degrees from the respective end portions to form intermediate sections 328 and 330. The intermediates sections 328 and 330 are parallel. The remainder or mid section 322 of each rail 280 should then extend between the intermediate sections 328 and 330 at an angle of 90 degrees with respect to the intermediate sections 328 and 330.

To assemble the retaining system 270, the first end 324 of the first rail 280*a* is inserted into the first channel 218 of the first railing retainer 272*a* from the first end 286 and the second end 326 of the first rail 280*a* is inserted into the first channel 218 of the second railing retainer 272*b* from the first end 286 of that railing retainer 272*b*. Likewise, the first end 324 of the second rail 280*b* in inserted into the second channel 300 of the first railing retainer 272*b* from the second end 288 and the second end 326 of the second rail 280*b* is inserted into the second channel 300 of the second railing retainer 272*b* from the second end 288 of that railing retainer 272*b*.

Each retainer cover 276 is positioned on a respective railing retainer 272*a* and 272*b* as follows. The body portion 314 of the retainer cover 276 is aligned with the body portion 284 of the railing retainer 272 and the cover 276 is then brought into contact with railing retainer 272. As the side walls 316 and 318 of the retainer cover 276 contact the upper rounded surface 296 of the side walls 290 and 292, the side walls 316 and 318 of the retainer cover 276 deflect outwardly enabling further downward movement of the retainer cover 276 outwardly of the side walls 290 and 292. Sufficient downward movement enables the projections 322 of the side walls 316 and 318 to pass the upper rounded surface 296 on the side walls 290 and 292 of the railing retainer 272 and deflect inwardly so that the projections 322 abut a lower portion of the upper rounded surfaces 296 thus holding the retainer cover 276 in place. The retainer covers 276 encase the portions of the rails 280 and 282 that are in the channels 298 and 300 so that the ends 324 and 326 of the rails 280 cannot exit the retailing retainers 272.

Figure 16:
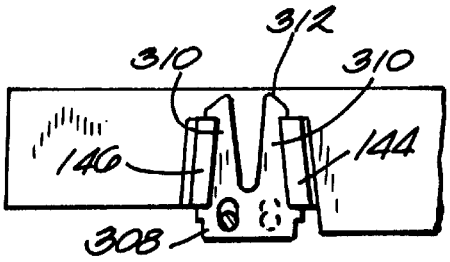
FIG. 16 is a partial side view of the product display depicting the interengagement of the railing retainer and the tray.

After the retainer cover 276 corresponding to each railing retainer 272 is positioned, the retaining system 270 can be assembled on the track 34 as follows. The first and second railing retainers 272*a* and 272*b* having retainer covers 276 attached thereto are positioned below the track 34 such that the pair of retaining clips 308 on the railing retainers 272*a* and 272*b* are aligned with the respective guide members 142 on the respective side walls 112 and 114 of the tray 110. Upward movement of the railing retainer 272*a* and 272*b* cause the legs 310 of the retaining clips 308 to enter the channels 152 and be deflected inwardly by the angled projections 144 and 146. When the legs 310 have moved sufficiently upward, the hook portions 312 clear the top of the projections 144 and 146 and are allowed to deflect outwardly thus securing the railing retainers 272 in place under the track 34 (FIG. 16).

In operation, the product display 30 performs as follows. In the loading or second mode of operation, the tray 110 is disengaged from the track 34 to that the tray 110 can move independently of and slide along the track 34. To disengage the tray 110 from the track 34, the arm 174 of the resilient leg 170 of the tray 34 is manually moved downwardly through the apertures 190 and 56 in the tray 110 and the track 34 respectively to disengage the hook 180 of the resilient leg 170 from the aperture 56 of the track 34 (FIG. 12). As shown in FIG. 2, the tray 110 is then slid forwardly to enable convenient and easy loading products P onto the top wall 118 of the tray 110. It should be noted that the stops 196 on the bottom surface 186 of the top wall 118 of the tray 110 ensure that the tray 110 is not slid forwardly completely off of the track 34. Forward motion of the tray 110 ceases when the tray 110 is moved forwardly enough so that the stops 196 contact the front end 64 of the trough 62.

With the tray 110 moved forwardly from the track 34 as shown in FIG. 2, the rails 280 are then moved outwardly to ensure that the products P are positionable between the rails 280. The rails 280 are moveable outwardly by manually grasping the rails 280 and applying an outwardly directed force. After being moved outwardly a suitable distance, the rails 280 maintain the selected position due to the friction on the rails 280 from the scalloped relived areas 306 on the center wall 304 of the respective railing retainer 272. With the tray 110 moved forwardly and the rails 280 moved outwardly, products P can be loaded between the front plate 198 and the pusher plate 242 without having to awkwardly push the pusher plate 242 rearwardly and load the products onto the tray 110 simultaneously.

After the products P are loaded onto the top wall 118 of the tray 110, the front wall 116 and front plate 198 are manually pushed rearwardly causing the products P to exert a force of the pusher plate 242. Continued force in this direction moves the pusher plate 242 rearwardly until the resilient leg 170 of the tray 110 engages the aperture 56 of the track 34 to interengage the tray 110 and the track 34 as discussed above (FIG. 12). In this position, the tray 110 is not moveable independent of the track 34. The rails 280 are then moved inwardly until the mid section 322 of the rails 280 is adjacent to the sides of the products P as depicted in FIG. 1. The mid section 322 of the rails 280 should be close to but not contacting the sides of the products P for easier product removal. The product display 30 is now ready for its regular mode of operation.

In the regular mode of operation, the front plate 198 serves to contain the products P on the top wall 116 of the tray 110. The rails 280 are adjustable to contain various sizes of products so that the products do not fall off of the tray 110 over the side of the product display 30. Due to the fact that the rails 280 are adjustable, the product display 30 can accommodate varying sizes of products with only one model of product display 30.

When a consumer desires a product P housed on the product display 30, the consumer takes a hold of the product P and lifts upwardly to remove the product P from the product display 30. After a product P has been removed, the coil portion 268 of the coil spring 244 exerts a force on the pusher plate 242 such that the pusher plate 242 moves forwardly and the remainder of the products P on the tray 110 are moved forward until the products P are all located adjacent the front plate 198.

The product display 30 can be adapted for use on or with various support surfaces in a retail establishment. Preferably, and as shown in FIGS. 1 and 2, the product display 30 includes the hook portion 104 on the side supports 92 to secure the product display 30 to the grid system 32. The grid system 32 includes a plurality of horizontal rods 340. The hook portions 104 of the side supports 92 surround one of the horizontal rods 340*a* with the projections 106 on the side supports 92 contacting the underside of another adjacent horizontal rod 340*b* spaced below the horizontal rod 340*a*. The projections 106 provide additional support for the product display 30 on the grid system 32.

Alternately, the product display 30 can be secured to a shelf, used in conjunction with peg board or used in conjunction with vertical slotted columns.

Preferably, the track 34, tray 110, front plate 198, railing retainers 272 and retainer covers 276 are fabricated of ABS plastic by an injection molding process. Alternately, the track 34, tray 110, front plate 198, railing retainers 272 and retainer covers 276 can be fabricated of styrene plastic by an injection molding process.

I claim:

1. A product display comprising:

a first member having therein a channel;

a second member positionable over and selectably slidable on said first member, said second member having therein an aperture aligned with said channel and including a front wall and a display surface adapted to support products to be displayed;

means on said first and second members for interengaging said first and second members to selectively prohibit said second member from sliding on said first member and to alternately allow said second member to slide on said first member; and a biasing mechanism positioned in said channel for urging products on said display surface toward said front wall.

2. A product display as set forth in claim 1 wherein said first member and said second member are generally rectangular.

3. A product display as set forth in claim 1 wherein said channel is generally rectangular, elongate and centrally positioned on said first member.

4. A product display as set forth in claim 1 wherein said display surface has thereon raised ribs.

5. A product display as set forth in claim 1 wherein said interengaging means includes a resilient leg on said second member and a slot on said first member.

6. A product display as set forth in claim 1 wherein said biasing mechanism includes a coil spring and a pusher plate.

7. A product display as set forth in claim 1 and further including means for securing said product display to a support structure.

8. A product display as set forth in claim 1 and further including a front plate positioned on said front wall of said second member adapted to prohibit products from inadvertently exiting said product display.

9. A product display as set forth in claim 1 and further including a guide positioned on one side of said product display, said guide being selectively moveable toward and away from said second member.

10. A product display as set forth in claim 1 and further including a pair of guides with one of said guides positioned on each side of said second member, said guides being selectively moveable toward and away from said second member.

11. A product display as set forth in claim 9 wherein said guide includes a shaped cylindrical railing.

12. A product display as set forth in claim 11 wherein said railing includes first and second ends that are positioned to move below said first member.

13. A product display as set forth in claim 12 and further including a railing retainer positioned below said first member, said railing retainer having a pair of passageways that house said first and second ends of said railing such that said first and second ends are moveable within said passageways.

14. A product display comprising:

a first member having therein a channel;

a second member positionable over and selectably slidable on said first member, said second member having therein an aperture aligned with said channel and a display surface adapted to support products to be displayed, said second member having a first side and a second side; and a guide positioned on each side of said second member, said guides being selectively moveable toward and away from said sides of said second member to approximate the width of the products to be displayed on said product display.

15. A product display as set forth in claim 14 wherein said guides include a shaped cylindrical railing.

16. A product display as set forth in claim 15 wherein said railing includes first and second ends that are positioned to move below said first member.

17. A product display as set forth in claim 16 and further including a railing retainer positioned below said first member, said railing retainer having a pair of passageways that house said first and second ends of said railing such that said first and second ends are moveable within said passageways.

18. A product display as set forth in claim 14 wherein said first member and said second member are generally rectangular.

19. A product display as set forth in claim 14 wherein said channel is generally rectangular, elongate and centrally positioned on said first member.

20. A product display as set forth in claim 14 wherein said display surface has thereon raised ribs.

21. A product display as set forth in claim 14 wherein said second member has a front wall and further including a biasing mechanism positioned in said channel for urging products on said display surface toward said front wall.

22. A product display as set forth in claim 21 wherein said biasing mechanism includes a coil spring and a pusher plate.

23. A product display as set forth in claim 14 and further including a means on said first member and said second member for interengaging said second member to said second member to selectively prohibit said second member from sliding on said first member and to alternately allow said second member to slide on said first member.

24. A product display as set forth in claim 23 wherein said interengaging means includes a resilient leg on said second member and a slot on said first member.

25. A product display as set forth in claim 14 further including means for securing said product display to a support structure.

26. A product display as set forth in claim 14 and further including a front plate positioned on said front wall and adapted to prohibit products from inadvertently exiting said product display.

27. A product display comprising:

a track having therein an elongate channel;

a tray having a top surface upon which products are displayed, said top surface having therein an elongate aperture that communicates with said channel, said tray including a front wall;

interengagable members on said track and said tray for enabling said tray to have a first mode of operation wherein said interengagable members are disengaged allowing said tray to move relative to said track and a second mode of operation wherein said interengagable members are interengaged prohibiting movement of said tray relative to said track;

biasing member positioned in said channel for urging the products to be displayed toward said front wall; and at least one guide member positioned adjacent said display surface for containing products on said display surface.

28. A product display as set forth in claim 27 wherein said track and said tray are generally rectangular.

29. A product display as set forth in claim 27 wherein said channel is generally rectangular, elongate and centrally positioned on said track.

30. A product display as set forth in claim 27 wherein said display surface has thereon raised ribs.

31. A product display as set forth in claim 27 wherein said interengagable members on said track and said tray include a resilient leg on said tray and a slot on said track.

32. A product display as set forth in claim 27 wherein said biasing member includes a coil spring and a pusher plate.

33. A product display as set forth in claim 27 and further including means for securing said product display to a support structure.

34. A product display as set forth in claim 27 and further including a front plate positioned on said front wall and adapted to prohibit products from inadvertently exiting said product display.

35. A product display as set forth in claim 27 wherein said guide member includes a shaped cylindrical railing.

36. A product display as set forth in claim 35 wherein said railing includes first and second ends that are positioned to move below said track.

37. A product display as set forth in claim 36 and further including a railing retainer positioned below said track, said railing retainer having a pair of passageways that house said first and second ends of said railing such that said first and second ends are moveable within said passageways.

* * * * *